US008777013B1

(12) United States Patent
Jalindre

(10) Patent No.: US 8,777,013 B1
(45) Date of Patent: Jul. 15, 2014

(54) PACKAGING FOR PHARMACEUTICALS INCLUDING CONTRACEPTIVES

(71) Applicant: The Challenge Printing Company, Clifton, NJ (US)

(72) Inventor: Swaraj Sunil Jalindre, West Orange, NJ (US)

(73) Assignee: The Challenge Printing Company, Clifton, NJ (US)

( * ) Notice: Subject to any disclaimer, the term of this patent is extended or adjusted under 35 U.S.C. 154(b) by 0 days.

(21) Appl. No.: 13/841,312

(22) Filed: Mar. 15, 2013

(51) Int. Cl.
*B65D 83/04* (2006.01)

(52) U.S. Cl.
USPC ..... 206/534; 206/534.1

(58) Field of Classification Search
USPC ..... 206/528, 529, 530, 531, 532, 534, 206/534.1, 534.2, 536, 538, 539, 558, 206/459.5, 828
See application file for complete search history.

(56) References Cited

U.S. PATENT DOCUMENTS

| | | | | |
|---|---|---|---|---|
| D177,651 | S | 5/1956 | Stubbs | |
| D186,859 | S | 12/1959 | Herman | |
| 2,971,638 | A | 2/1961 | Allison et al. | |
| 3,976,196 | A | 8/1976 | Mueller | |
| 4,053,054 | A * | 10/1977 | Lucas | 206/534 |
| 4,706,815 | A | 11/1987 | Curtis et al. | |
| 4,889,236 | A | 12/1989 | Bartell et al. | |
| 4,958,736 | A | 9/1990 | Urheim | |
| 5,014,851 | A * | 5/1991 | Wick | 206/539 |
| D324,819 | S | 3/1992 | Eisenberg | |
| D335,081 | S | 4/1993 | Pierantozzi et al. | |
| D387,977 | S | 12/1997 | Källgren | |
| D392,562 | S | 3/1998 | Lo | |
| 5,775,505 | A | 7/1998 | Vasquez et al. | |
| 5,833,072 | A | 11/1998 | Lambelet, Jr. | |
| 5,899,335 | A * | 5/1999 | Boyer et al. | 206/538 |
| 6,155,423 | A | 12/2000 | Katzner et al. | |
| 6,258,379 | B1 | 7/2001 | Weinstein et al. | |
| 6,802,422 | B2 | 10/2004 | Kalvelage et al. | |
| D511,977 | S | 11/2005 | Saelzer | |
| D548,110 | S | 8/2007 | Pugh | |
| D650,295 | S | 12/2011 | Schmitz et al. | |
| D658,077 | S | 4/2012 | Newman | |
| 8,584,857 | B2 | 11/2013 | Ozawa et al. | |
| 2002/0045184 | A1 | 4/2002 | Chen | |
| 2006/0283759 | A1 * | 12/2006 | Nivala | 206/531 |
| 2007/0131576 | A1 * | 6/2007 | Ehling et al. | 206/528 |
| 2007/0158232 | A1 | 7/2007 | Spector | |
| 2009/0078606 | A1 * | 3/2009 | Conley et al. | 206/534 |
| 2009/0242453 | A1 * | 10/2009 | Hannan et al. | 206/534 |
| 2011/0305775 | A1 | 12/2011 | Gervais et al. | |
| 2012/0305584 | A1 * | 12/2012 | Carson et al. | 221/1 |

* cited by examiner

*Primary Examiner* — Jacob K Ackun
(74) *Attorney, Agent, or Firm* — Greer Burns & Crain Ltd.

(57) ABSTRACT

A package for pharmaceuticals such as contraceptives has a mold having a plurality of indentations arranged in a predetermined manner. The indentations are arranged in four circular patterns, each pattern being located in one of four quadrants defined by internal perforated boundaries. A lidding cover is adhered to the mold. The lidding cover has printed material that identifies the locations of the indentations and the internal perforated boundaries of the four quadrants.

7 Claims, 6 Drawing Sheets

PACKAGING FOR PHARMACEUTICALS INCLUDING CONTRACEPTIVES

This invention relates to pharmaceutical packaging, and more particularly to packaging for those products such as contraceptives taken in weekly cycles.

BACKGROUND OF THE INVENTION

Pharmaceutical products and pills such as contraceptives are often taken on a daily basis over a four week cycle. To treat one or more illnesses, multiple drugs are often prescribed. In both situations, accurate portion control is critical, as is ease of usage and convenience.

Accordingly, one object of the present invention is to provide a new and improved package for pharmaceuticals that reliably controls the timing and number of pills taken over a period of time such as a week or a month.

Another object is to provide a package for pharmaceuticals such as contraceptives that is easy and convenient to use.

SUMMARY OF THE INVENTION

In keeping with one aspect of this invention, a package for pharmaceuticals such as contraceptives includes a mold having a plurality of indentations arranged in a predetermined manner. The indentations are preferably large enough to accommodate one or more than one pill. The indentations are arranged in four circular patterns, each pattern being located in one of four quadrants defined by internal perforated boundaries.

A lidding cover is adhered to the mold except over the indentations. The lidding cover may or may not be perforated along the internal perforated boundaries. The lidding cover is printed with instructional information, and identifies the locations of the indentations and the internal perforated boundaries of the four quadrants.

BRIEF DESCRIPTION OF THE DRAWINGS

The above mentioned and other features of this invention and the manner of obtaining them will become more apparent, and the invention itself will be best understood by reference to the following description of an embodiment of the invention taken in conjunction with the accompanying drawings, in which.

DETAILED DESCRIPTION

Figure 1:
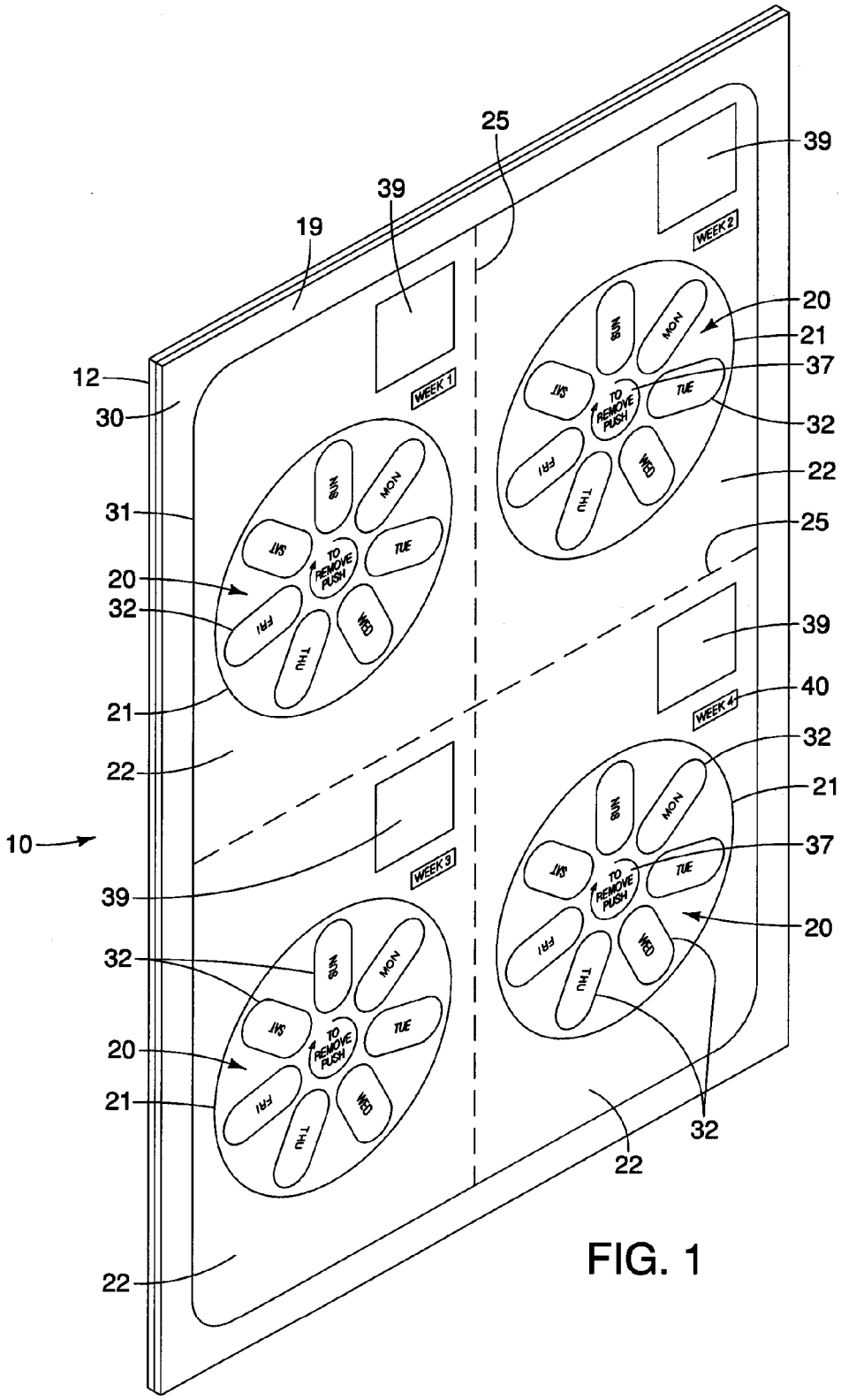
FIG. 1 is a perspective view of one embodiment of the present invention.
Figure 2:
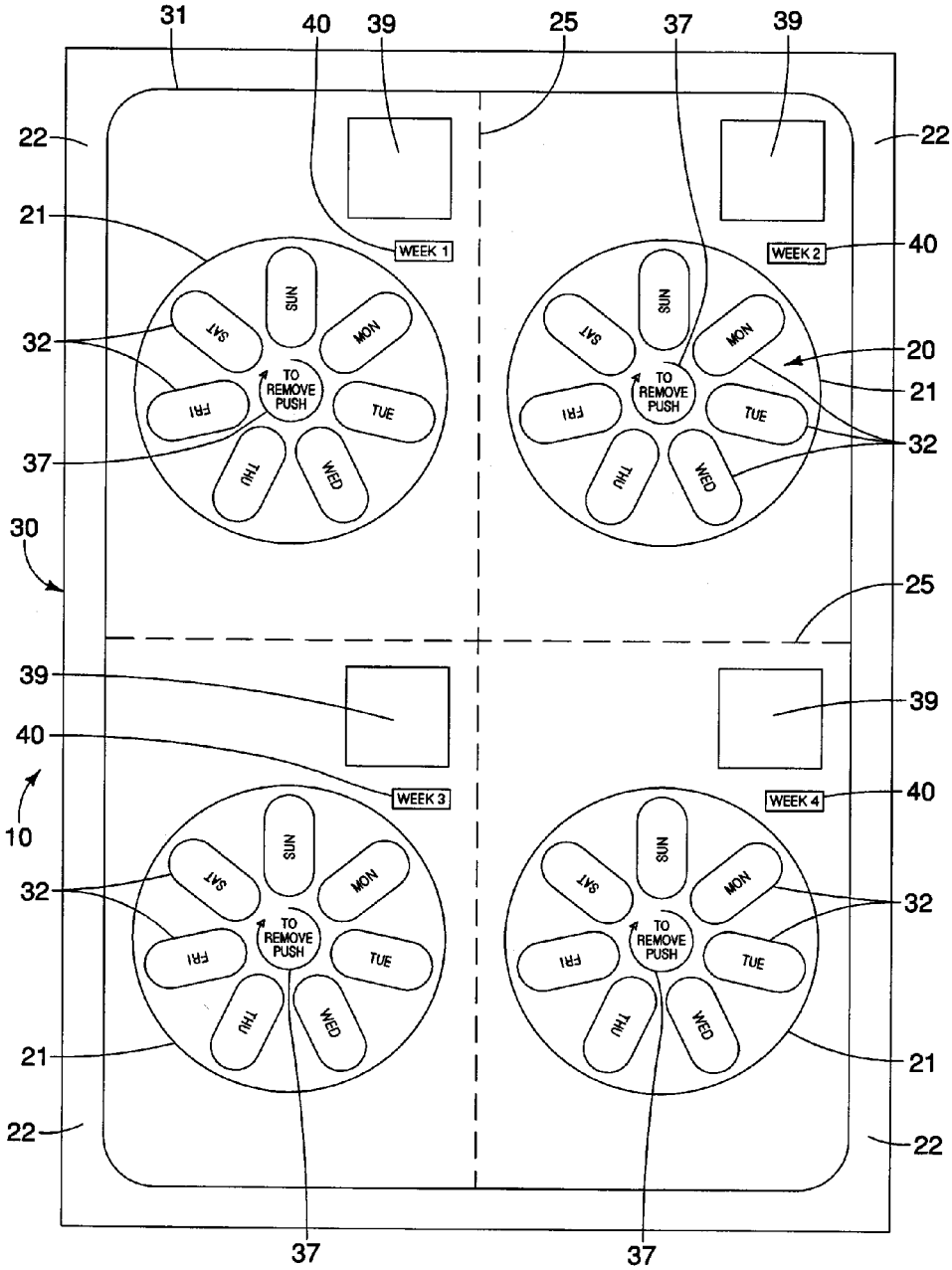
FIG. 2 is a front view of the package of FIG. 1.
Figure 3:
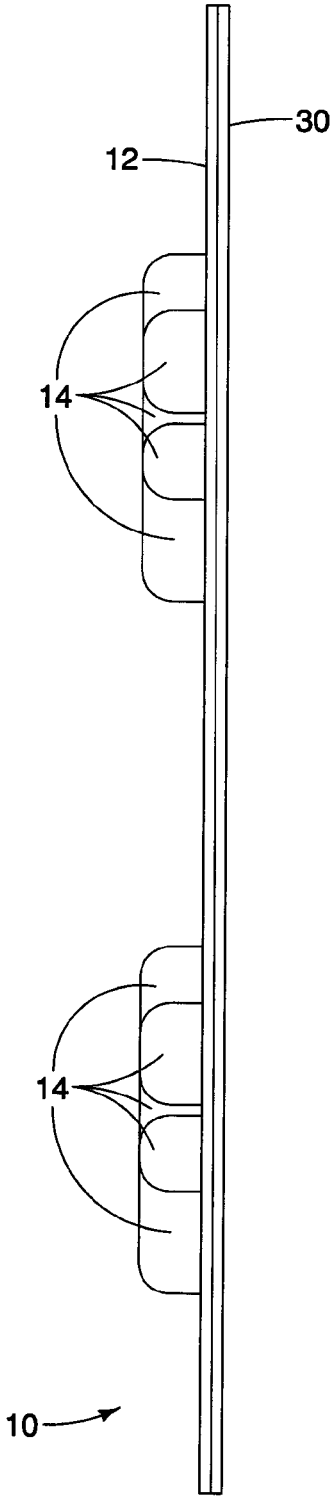
FIG. 3 is a left side view of the package of FIG. 3.
Figure 4:
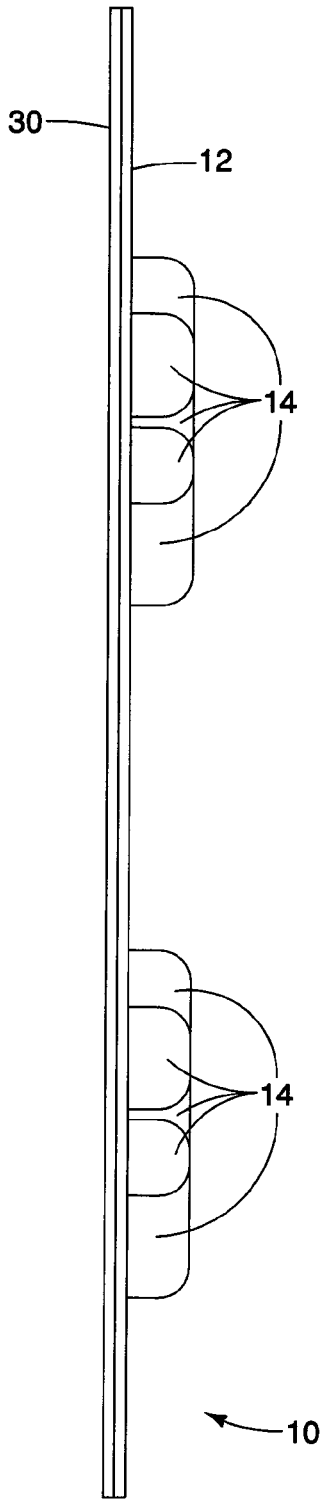
FIG. 4 is a right side view of the package of FIG. 1.
Figure 5:
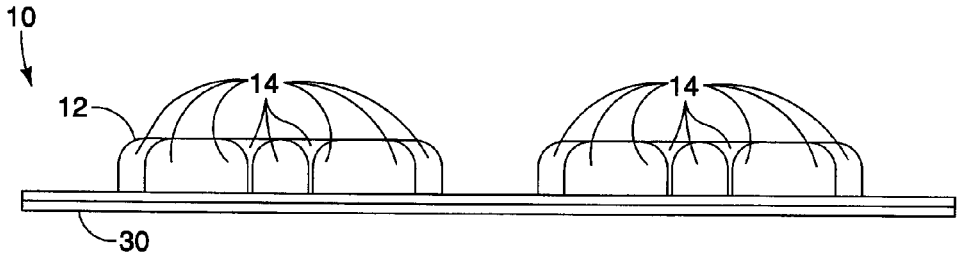
FIG. 5 is a top view of the package of FIG. 1.
Figure 6:
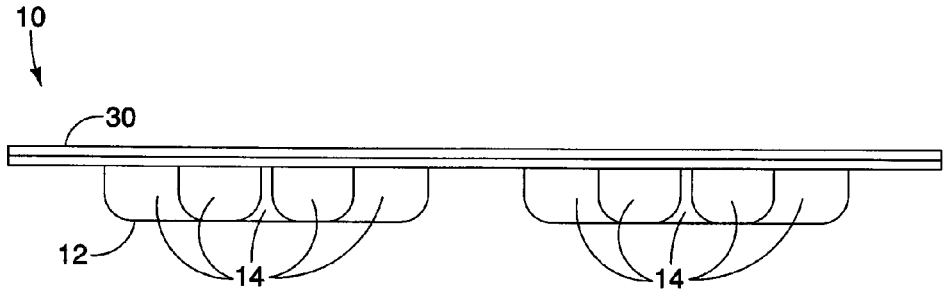
FIG. 6 is a bottom view of the package of FIG. 1.
Figure 7:
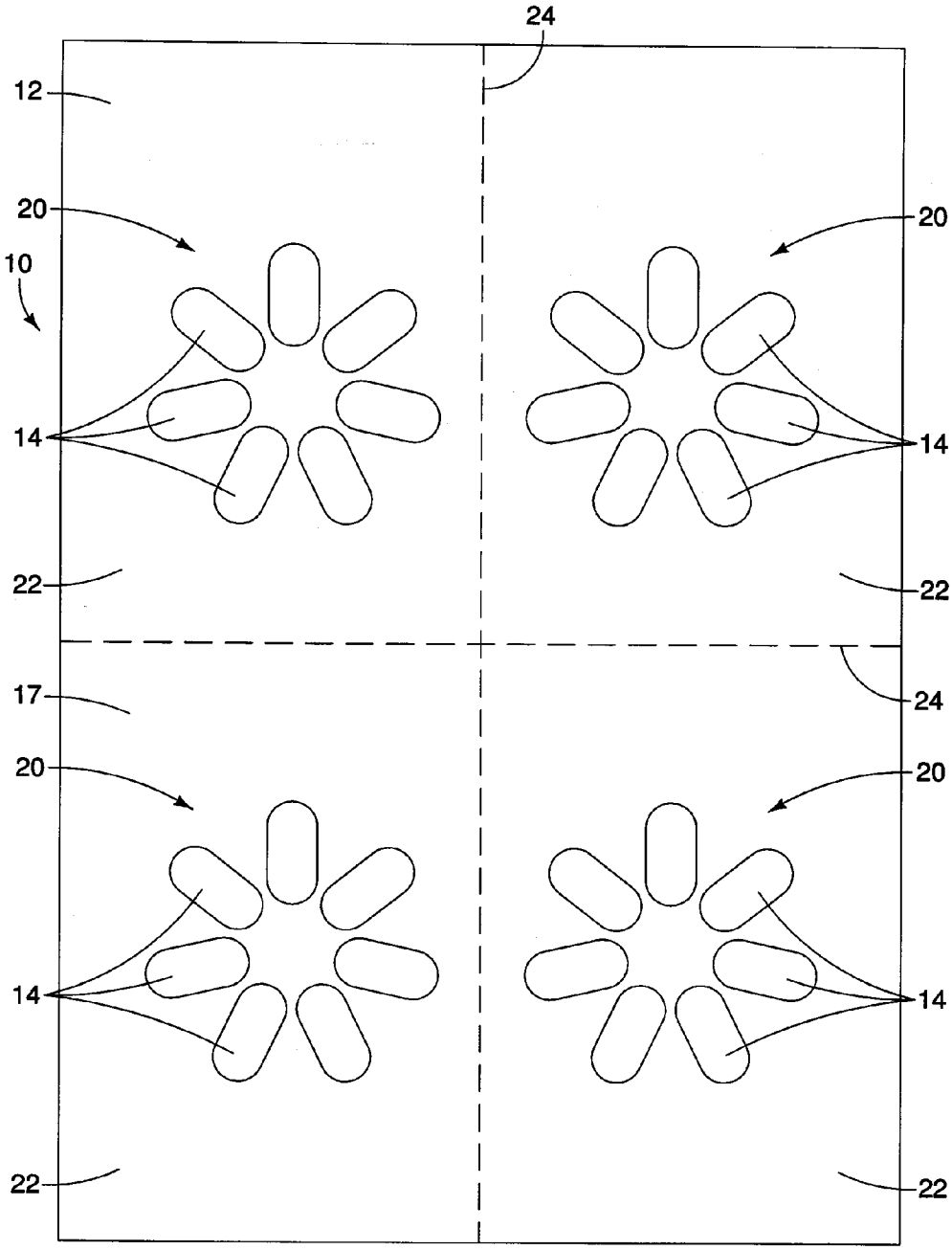
FIG. 7 is a rear view of the package of FIG. 1.
Figure 8:
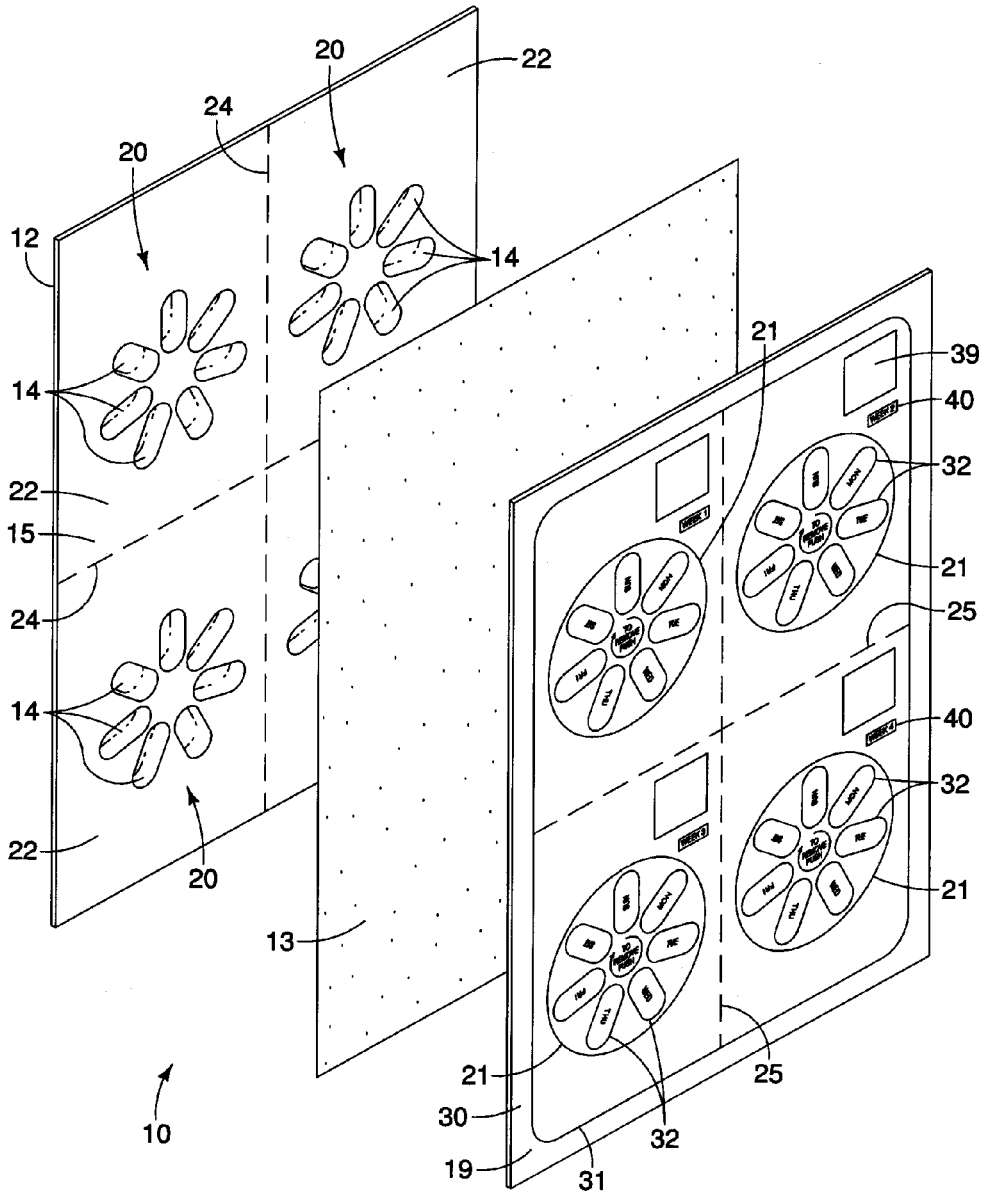
FIG. 8 is an exploded view of the package of FIG. 1

As seen in the figures, package 10 is designed to dispense pharmaceuticals such as contraceptive pills on a daily basis. A typical dimension of the package 10 is about 5½ inches long and about 3½ inches wide, but the package 10 could be smaller or larger in size.

Package 10 includes a mold 12 made of plastic or the like. Thermoform plastic blister pack is suggested for the mold 12. The mold 12 has a front side 15, a back side 17, and plurality of indentations 14 arranged in circular patterns. The indentations 14 are generally oval shaped, and are large enough to hold one pill or more than one pill in this embodiment.

Indentations 14 are preferably arranged in the four circular patterns 20. Each pattern is located in one of four quadrants 22, defined by internal criss-crossing perforated boundaries 24.

A lidding cover 30 is adhered to the front side 15 of the mold 12 except over the indentations 14. The lidding cover 30 is adhered to the mold 12 using a layer 13 of heat seal adhesive. The indentations 14 are deep enough so that the pills in the indentations do not contact the lidding cover 30 when heat is applied to the adhesive 13 for sealing purposes.

The lidding cover 30 is preferably made of a pliable material or stock such as 25 μm aluminum foil or plastic material, so that the pills can be easily removed one day at a time by breaking the cover over individual indentations, without removing the cover entirely from the front side 15. A front surface 19 of the lidding cover 30 has a printable coating such as a primer.

The lidding cover 30 is printed with a border 31 surrounding all of the patterns 20, four circular outlines 21 individually surrounding each of the patterns 20, oval lines 32 for identifying the locations of the indentations 14, as well as dotted lines 25 identifying the internal perforated boundaries 24 of the four quadrants 22. Preferably, each day of the week (MON, TUE, WED, THU, FRI, SAT, SUN) is printed in successive ovals 32 that correspond to each of the indentations 14. Instructional information such as "TO REMOVE PUSH" with a clockwise arrow 37 indicating the direction in which pills are removed from the indentations 14 during a one week can also be provided, as well as serialized linear or two-dimensional bar codes 39, week identifiers 40, trademark or other information. Additional printed matter can be added, if desired.

This embodiment is useful for pharmaceuticals that are taken once daily over a four week period. The oval shape and size of the indentations contemplates one or more pills in each indentation. While contraceptive pills are particularly suited for this invention, other pharmaceuticals, including drug combinations taken once daily or less, can be accurately dispensed. The packaging is convenient and easy to use because the perforations allow the four quadrants to be separated so that pharmaceuticals for only one week can be easily carried.

While the principles of the invention have been described above in connection with specific apparatus and applications, it is to be understood that this description is made only by way of example and not as a limitation on the scope of the invention.

What is claimed is:

1. A package for pharmaceuticals comprising:

a mold having a plurality of indentations arranged in a predetermined manner, the indentations being arranged in four circular patterns, each pattern being located in one of four quadrants defined by perforated boundaries in the mold, and a lidding cover adhered to the mold by an adhesive layer, except over the indentations, the lidding cover identifying the locations of the indentations and the internal perforated boundaries of the four quadrants.

2. The package of claim 1, wherein the mold is made of thermoform plastic.

3. The package of claim 1, wherein the lidding cover includes a printed border surrounding the four circular patterns, a printed circular or outline surrounding each of the patterns 20, and printed instructions.

4. The package of claim 1, wherein the lidding cover includes a layer of aluminum foil coated with a printable material.

5. The package of claim 1, wherein the lidding cover is made of a pliable material.

6. The package of claim 1, wherein the lidding cover may or may not be perforated along the internal perforated boundaries.

7. The package of claim 1 wherein the pharmaceutical is a contraceptive.

* * * * *